US009155918B2

(12) United States Patent
Krumrei

(10) Patent No.: US 9,155,918 B2
(45) Date of Patent: Oct. 13, 2015

(54) BATTERING RAM

(76) Inventor: David T. Krumrei, Exeland, WI (US)

( * ) Notice: Subject to any disclaimer, the term of this patent is extended or adjusted under 35 U.S.C. 154(b) by 563 days.

(21) Appl. No.: 13/541,120

(22) Filed: Jul. 3, 2012

(65) Prior Publication Data

US 2013/0168117 A1 Jul. 4, 2013

Related U.S. Application Data

(63) Continuation-in-part of application No. 12/322,798, filed on Feb. 6, 2009, now abandoned.

(60) Provisional application No. 61/063,936, filed on Feb. 7, 2008.

(51) Int. Cl.
*A62B 3/00* (2006.01)

(52) U.S. Cl.
CPC ..... *A62B 3/005* (2013.01)

(58) Field of Classification Search
CPC ..... B25D 9/11; B23P 19/04
USPC ..... 173/90, 200, 112, 206, 209; 29/254, 29/275; 269/151
See application file for complete search history.

(56) References Cited

U.S. PATENT DOCUMENTS

| | | | | |
|---|---|---|---|---|
| 434,976 | A | | 8/1890 | Chouteau |
| 4,003,119 | A | | 1/1977 | Hugh |
| 4,665,994 | A | | 5/1987 | Snider |
| 4,681,171 | A | | 7/1987 | Kee et al. |
| 4,789,134 | A | | 12/1988 | Tenuto, Jr. et al. |
| 4,850,437 | A | | 7/1989 | Sudnishnikov et al. |
| 5,044,033 | A | | 9/1991 | Fosberg |
| 5,067,237 | A | | 11/1991 | Holder |
| 5,088,174 | A | | 2/1992 | Hull et al. |
| 5,167,043 | A | | 12/1992 | Lopez et al. |
| 5,177,850 | A | | 1/1993 | Hull et al. |
| 5,243,761 | A | | 9/1993 | Sullivan et al. |
| 5,329,685 | A | * | 7/1994 | Gillespie ..... 29/254 |
| 5,398,773 | A | | 3/1995 | Baker |
| 5,408,795 | A | | 4/1995 | Eljadi et al. |
| 5,415,241 | A | * | 5/1995 | Ruffu et al. ..... 173/212 |
| 5,540,136 | A | | 7/1996 | Noord |
| 5,987,723 | A | | 11/1999 | McNally et al. |
| 6,035,946 | A | | 3/2000 | Studley et al. |
| 6,318,228 | B1 | | 11/2001 | Thompson |
| 2003/0056352 | A1 | * | 3/2003 | McLellan et al. ..... 29/252 |

OTHER PUBLICATIONS

International Search Report and Written Opinion for Application Serial No. PCT/US2009/000776 dated May 26, 2009.
International Preliminary Report on Patentability or Application Serial No. PCT/US09/00776 dated Aug. 11, 2010.
USPTO Office Action for U.S. Appl. No. 12/322,798 dated Jan. 4, 2012.

* cited by examiner

*Primary Examiner* — Nathaniel Chukwurah
(74) *Attorney, Agent, or Firm* — Robinson IP Law, PLLC

(57) ABSTRACT

A battering apparatus including a battering element, an air source, a sensing device, a triggering mechanism, and a battering element release mechanism. Engagement of the sensing device activates the triggering mechanism which in turn activated the battering element release mechanism. The battering element is then released, and driven by air from the air source, moved to its extended position, causing the battering head of the battering element to engage an item to be broken.

4 Claims, 8 Drawing Sheets

BATTERING RAM

RELATED APPLICATIONS

This application is a continuation-in-part of co-pending U.S. patent application Ser. No. 12/322,798, filed 6 Feb. 2009, and entitled "Battering Ram", which claimed the benefit of U.S. Provisional Patent Application Ser. No. 61/063,936, filed 7 Feb. 2008, and entitled "Battering Ram."

BACKGROUND OF THE INVENTION

The present invention relates to a battering ram device for allowing quick forcible entry into rooms and buildings having doorways, windows, or other types of closures. Battering ram devices are often used by law enforcement officials to forcibly enter closures that are locked or by rescuers who find closures that are locked during a rescue situation.

Many battering rams comprise a heavy ram device which is swung toward a door to destroy the door. These battering rams require sufficient room to swing the battering ram, and many require at least two strong people to operate the ram.

SUMMARY OF THE INVENTION

The invention provides a battering apparatus and methods for operating the battering apparatus.

One aspect of the invention provides a battering apparatus including a body, a battering element and a triggering element. The body may include a manifold in fluid communication with a cavity. The battering element is disposed at least partially within the cavity and is movable between a first retracted position and a second extended position. The triggering element is coupled to the body.

The apparatus may also include an air source coupled to the body, the air source being in fluid communication with the manifold.

The air source in the apparatus may take the form of a self contained breathing apparatus bottle.

The battering element may include a head having a battering surface, a shaft having a first end and a second end, the first end of the shaft being coupled to the head, and a piston coupled to the second end of the shaft.

The apparatus may also include at least one air release element.

The air release element may also include at least one valve disposed in the piston, the at least one valve having a first closed position and a second open position.

The apparatus may also include at least one air release aperture extending through the body, the air release aperture being in fluid communication with the cavity.

The triggering element may take the form of a peg which is movable between a first inactive position and a second active position.

The apparatus may also include at least one valve within the manifold, the valve being operatively coupled to the triggering element.

The apparatus may also include a sensing device operatively coupled to the triggering element.

The apparatus may also include a safety element, the safety element coupled, directly or indirectly, to the triggering element.

The body of the apparatus may further include a reservoir, the reservoir being in fluid communication with the manifold.

The apparatus may also include a battering ram return element.

The battering ram return element may take the form of a spring.

The apparatus may also include at least one handle coupled, directly or indirectly, to the body.

The head of the apparatus may be removably coupled to the first end of the shaft.

The cavity and manifold of the apparatus may be separately formed and mechanically coupled to each other.

The apparatus may also include a guard element coupled to the body.

Another aspect of the invention provides a method including the steps of providing a battering apparatus, providing an air source in fluid communication with the manifold, activating the triggering element, extending the battering element, and retracting the battering element. The battering apparatus may include a body having a manifold and a cavity, the manifold in fluid communication with the cavity, the manifold having at least one normally closed valve, a battering element, the battering element disposed at least partially within the cavity, the battering element movable between a first retracted position and a second extended position, and a triggering element, the triggering element coupled to the body.

The method may also include the normally closed valve being operably coupled to the triggering element and activating the triggering element opens the normally closed valve in the manifold and provides air to the cavity.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

A single person hand held breaching apparatus 10 is provided. The breaching tool is preferably made of steel and aluminum, but may be made of any combination of materials to provide a strong, but relatively lightweight apparatus 10.

Figure 1A:
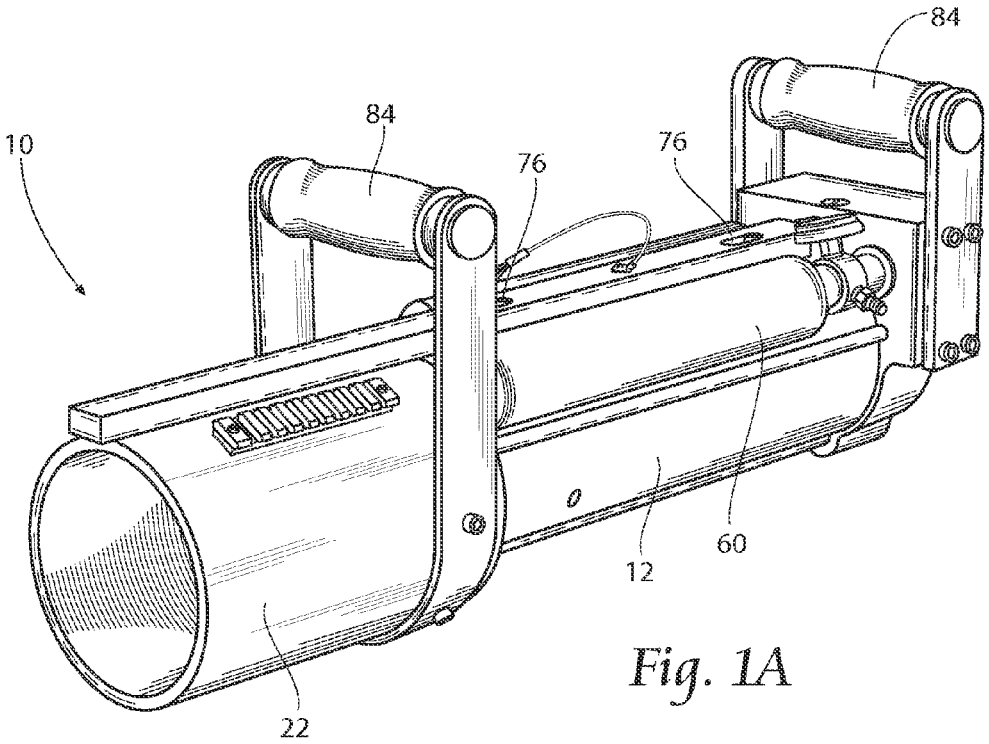
FIG. 1A is a perspective view of an embodiment of an apparatus according to the present invention.
Figure 2:
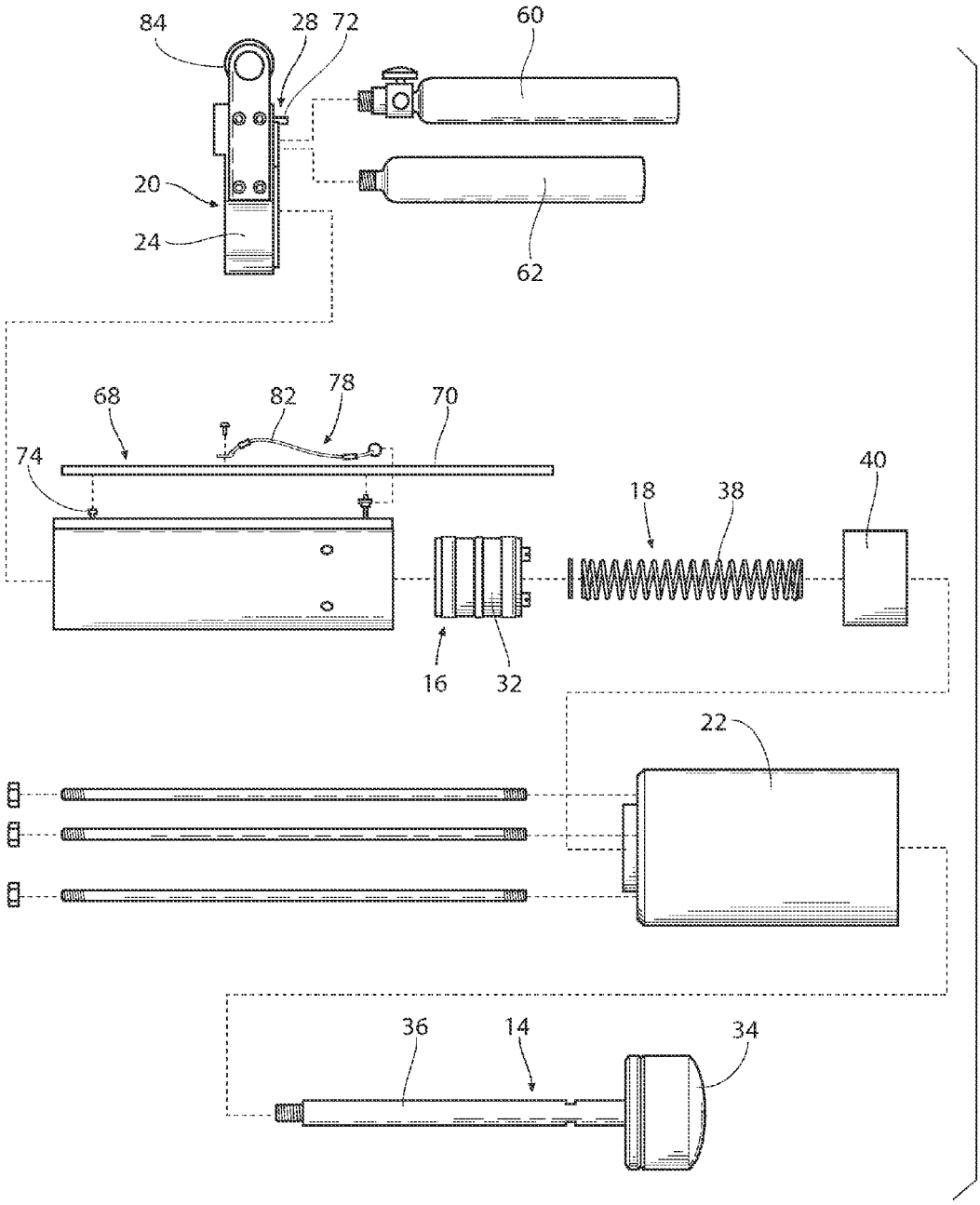
FIG. 2 is an exploded view of the apparatus of FIG. 1A.

As shown in FIGS. 1A and 2, the apparatus 10 includes a generally cylindrical body 12 which may act as an air chamber 66. The apparatus 10 preferably includes a battering element 14 disposed at least partially within the air chamber 66, an air release mechanism 16 associated with the air chamber 66, a battering element return mechanism 18, and a battering ram release mechanism 20. The apparatus 10 may also include a guard assembly 22 coupled to the cylindrical body 12. In the illustrated embodiment, the battering ram release mechanism 20 takes the form of a manifold 24 including a valve. When the triggering mechanism 28 is activated, air flows through the manifold 24 from the reservoir tank 62 to the air chamber 66. The pressure of the air entering the air chamber 66 causes the piston 32 to move forward to its extended position, this releasing the battering element 14.

Figure 3A:
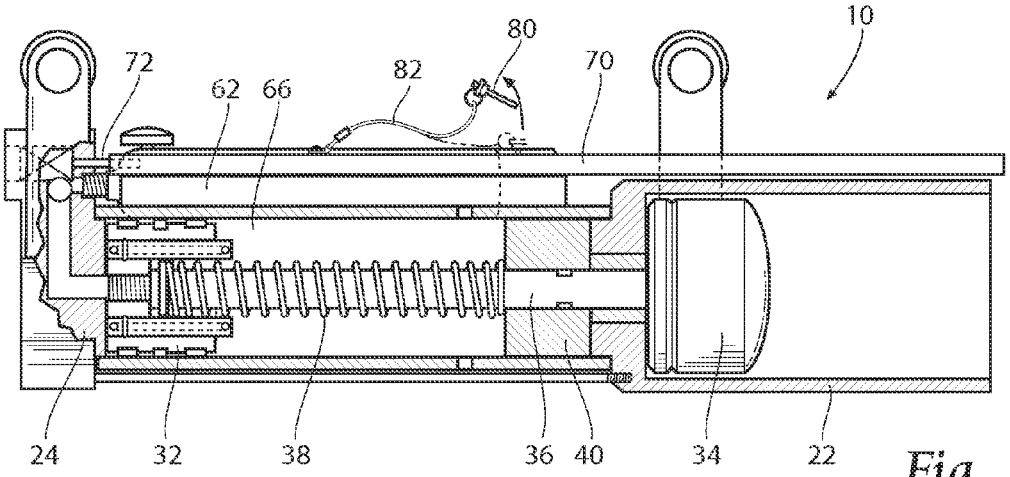
FIG. 3A-3E is a series of cut away side view of the apparatus of FIG. 1A, showing the apparatus in operation.
Figure 3B:
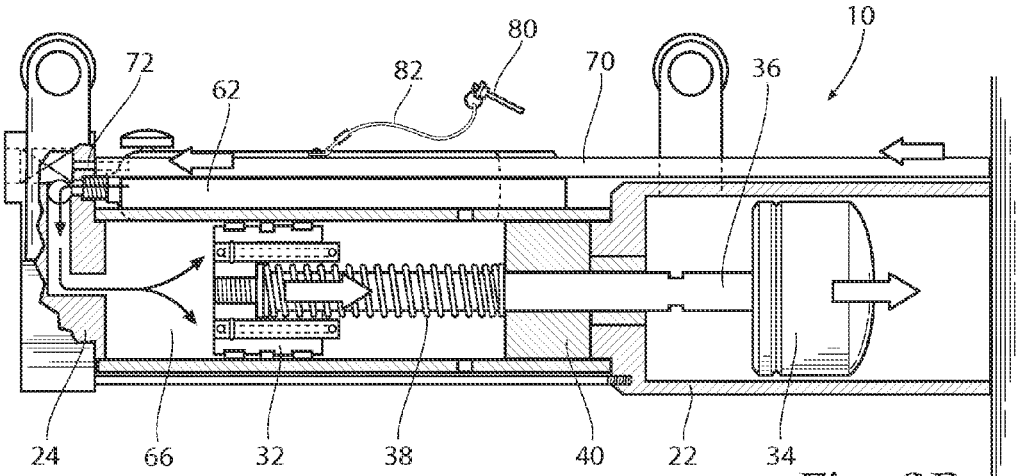
Figure 3C:
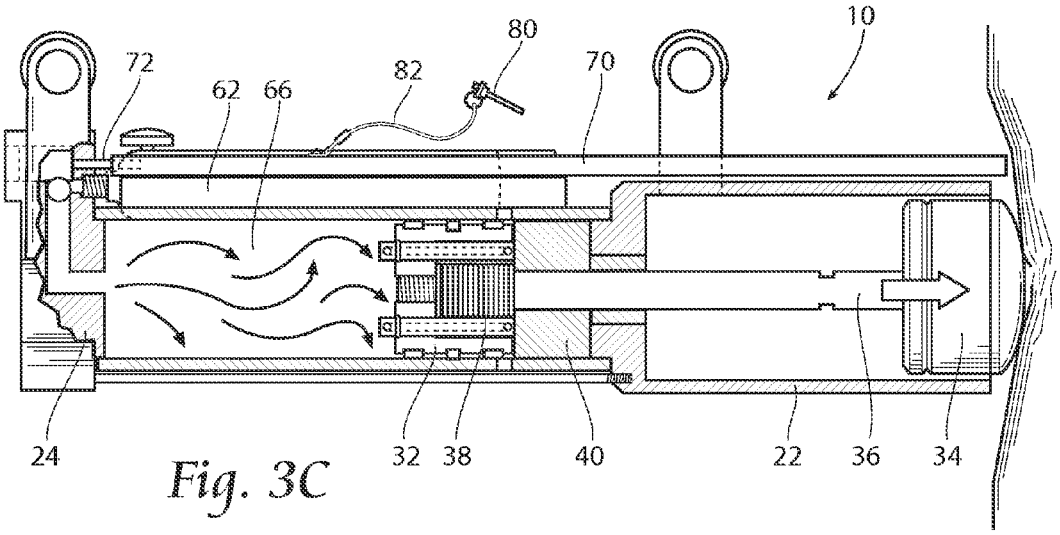

In the illustrated embodiment, the battering element 14 takes the form of a battering head 34 attached to a shaft 36. As shown in FIGS. 3A to 3E, the battering head 34 is preferably located within the guard 22 when the head is in its retracted position (FIG. 3A). When the battering head 34 is in its extended position, it extends at least partially out of the guard 22 (FIG. 3C).

In the illustrated embodiment, the battering ram return mechanism 18 takes the form of a spring 38. The spring 38 is preferably disposed between the bumper 40 and the piston 32. When the piston 32 is in its extended position the spring 38 is compressed. The spring 38 then returns to its normally extended position, pushing the piston 32 to its retracted position.

In the illustrated embodiment, as shown in FIGS. 3*a* to 3E, the air release mechanism 16 takes the form of a piston 32 coupled to the shaft 36. As shown in FIG. 4, the piston 32 includes a plurality of valves 42 to release air from the air chamber 66. The illustrated embodiment includes four valves 42, however, any number of valves 42 may be desirable depending on the particular configuration of the apparatus 10. The piston 32 may also include a sealing apparatus 10, such as a cup seal 44 to provide a tight seal within the air chamber 66. The piston may also include at least one wear band 46, such as a Teflon wear band 46 to reduce friction. In the illustrated embodiment, a pair a grooves is formed in the outer surface of the piston to accommodate a pair of wear bands 46.

When the piston 32 is in its retracted position (see FIG. 3B), the rear surface 52 of the valves 42 are flush with the rear surface 54 of the piston 32, and air cannot move through the valves 42 in the piston 32. In this configuration the valves 42 in the piston 32 are in the closed position. When the piston 32 is in its extended position, the front surface 56 of the valves 42 engage the bumper 40 and the valves 42 are pushed within the piston 32 such that the front surface 56 of the valves 42 are flush with the front surface 58 of the piston 32 (see FIG. 3C). In this manner, air can flow through the valves 42 (see FIG. 3D). In this configuration the valves 42 in the piston 32 are in their open position and air in the chamber 66 may be released through holes 48 and a channel 50 formed in the valves 42 and ultimately through holes formed in the chamber 66. As the piston 32 is returned to its retracted position, the rear surfaces 52 of the valves 42 engage the back wall of the air chamber 66 and push the valves 42 within the piston 32 such that the rear surfaces 52 of the valves 42 are once again flush with the rear surface 54 of the piston 32 (see FIG. 3E).

Figure 5:
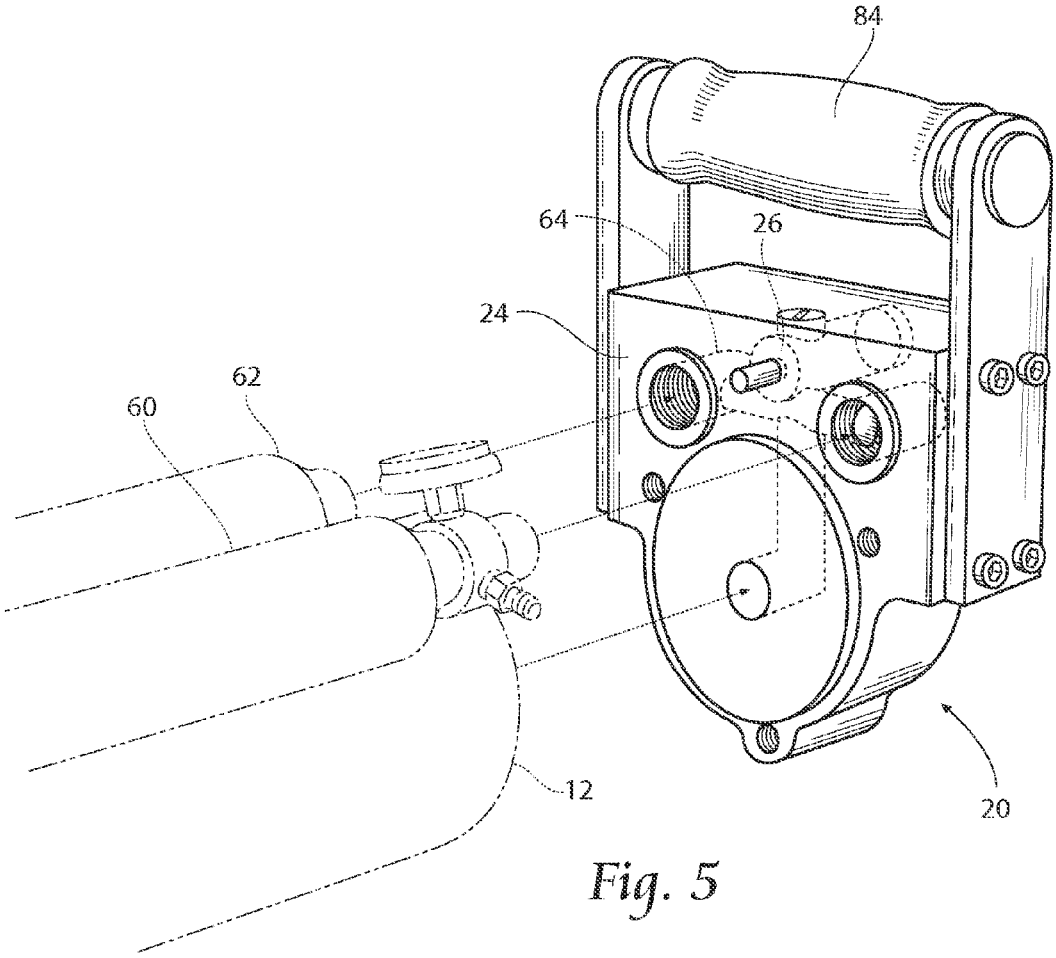
FIG. 5 is a partially exploded perspective view of a manifold such as that used in the apparatus of FIG. 1A.

The apparatus 10 preferably includes at least one air supply attached to the body 12 of the apparatus 10, as shown in FIGS. 1A and 5. The illustrated embodiment includes a supply tank 60 and a reservoir tank 62. The supply tank 60 is preferably a high pressure tank, for example 3000 psi. The tanks are preferably coupled to the body 12 through a manifold 24. The air preferably travels from the supply tank 60, through a regulator 64 to the reservoir tank 62. The reservoir tank 62 has a lower pressure, for example 450 psi. The reservoir tank 62 then provides air to the air chamber 66 to power the device.

The apparatus 10 preferable includes at least one sensing device 68. In the illustrated embodiment the sensing device 68 comprises a sensing bar 70, as shown in FIG. 1A. The sensing bar 70 is movable between a first normally extended position (FIG. 3A) and a second retracted position (FIG. 3B). The sensing bar 70 is preferably adapted to engage, either directly or indirectly the triggering mechanism 28. In the illustrated embodiment, when the sensing bar 70 is in its retracted position the triggering mechanism 28 is activated. In use, the sensing bar 70 is moved from its first position to the second position by swinging the sensing bar 70 into a door or other item to be rammed.

In the preferred embodiment the triggering mechanism 28 comprises a peg 72 which may be depressed by the sensing bar 70 when the sensing bar 70 is in its second retracted position. Depressing the peg 72 opens a valve 26 within the manifold 24.

The sensing bar 70 may be biased in the normally extended position by at least one spring. The illustrated embodiment utilizes two springs to urge the sensing bar 70 to the normally extended position.

In the illustrated embodiment, it is contemplated that the motion of the sensing bar 70 may be limited by the engagement of at least one upstanding member 74 with at least one slot 76 in the sensing bar 70.

Figure 1B:
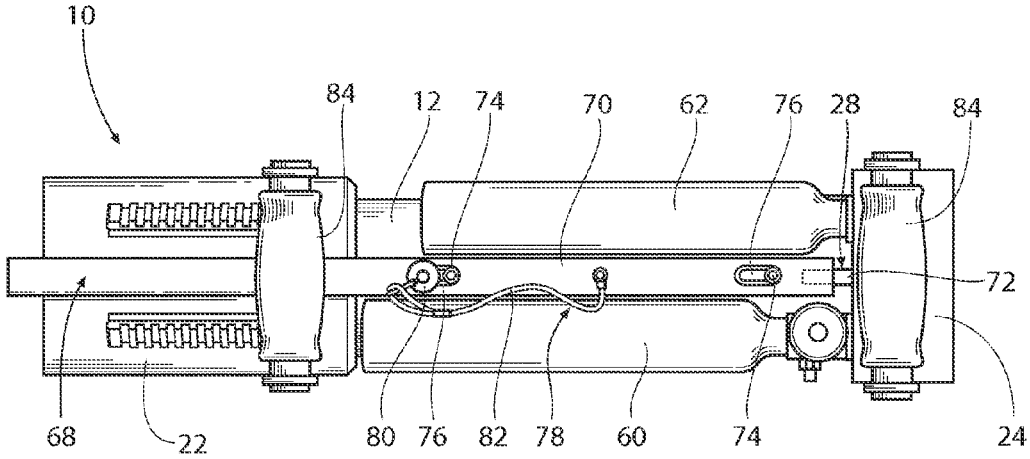
FIG. 1B is a top view of the apparatus of FIG. 1A.

The apparatus 10 preferably includes at least one safety mechanism 78. The safety mechanism 78 may take various forms and may take any form known in the art. In the preferred embodiment the safety mechanism 78 comprises a device which prevents movement of the sensing bar 70. As shown in FIG. 1B, in the illustrated embodiment the safety mechanism 78 takes the form of a pin 80 which is coupled to the body 12 through a flexible member 82. The pin 80 may be inserted into an aperture formed in the body 12 to prevent the sensing bar 70 from moving. When the pin 80 is removed from the aperture, the sensing bar 70 is free to slide.

The apparatus 10 preferably includes at least one handle 84 coupled to the body 12 of the apparatus 10. The illustrated embodiment includes a first handle 84 located at the rear of the apparatus 10 near the manifold 24 and a second handle 84 located near the front of the air chamber 66. However, it should be understood that the location and configuration of the handles 84 may be changed.

It is contemplated that different head 34 configurations may be best suited for different applications. For example, the optimum head 34 configuration may be different for breaking bricks, metal, or wood. Therefore it is contemplated alternate head 34 designs may be utilized. It is further contemplated that the apparatus 10 may include interchangeable heads 34 which may be removed and replaced to accommodate various conditions.

It is also contemplated that any type of air tank may be used. For example, SCBA (self contained breathing apparatus) tanks which are often used by firefighters may be attached to the apparatus 10. It is also contemplated that smaller emergency bottles, such as Ska-Pak bottles may be used. Such tanks may be connected to the manifold in any manner known in the art, for example with a whip hose and quick connects. Many firehouses have the means to refill such tanks, therefore this type of tank would be easy to refill and maintain.

FIGS. 3A to 3E show the operation of the illustrated embodiment. FIG. 3A shows the apparatus 10 in its retracted or unengaged position. The sensing bar 70 is in its first normally extended position. The piston 32 and battering head 34 are in their retracted positions. The safety mechanism is released and the apparatus 10 is ready to be used.

FIG. 3B shows the apparatus 10 as it is engaged with an item to be broken. The sensing bar 70 is moved to its second, retracted position. The valves 42 within the piston 32 are in their closed position, sealing the air chamber 66 behind the piston 32. The trigger pin is depressed, releasing air through the manifold 24 into the air chamber 66. The increased air pressure in the chamber 66 causes the piston 32, shaft 36, and battering head 34 to begin to move towards their extended position.

FIG. 3C shows the apparatus 10 in its extended position, with the battering head 34 engaging the item to be broken. The forward motion of the piston 32 and battering element 14 is limited by the engagement of the piston 32 with the bumper 40. The engagement of the piston 32 with the bumper 40 also moves the valves 42 within the piston 32 and causes the front surface 56 of the valves 42 to be flush with the front surface 58 of the piston 32, thus moving the valves 42 to the open position. The sensing bar 70 has returned to its normally extended position.

Figure 3D:
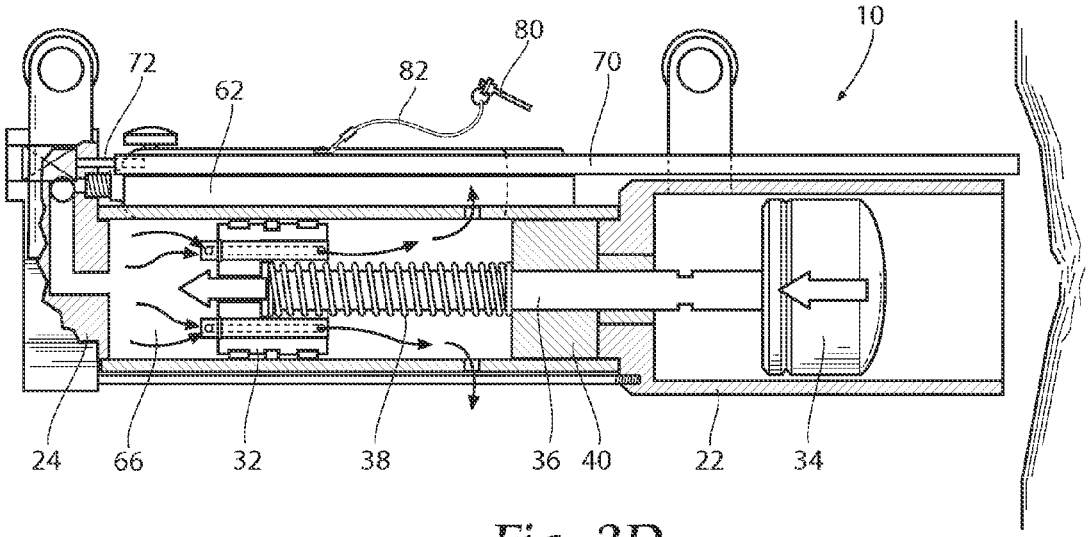
Figure 4:
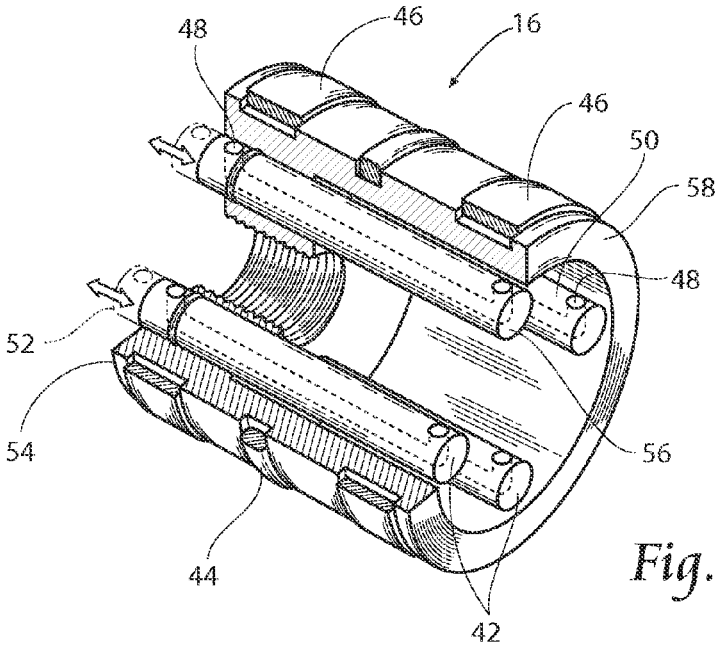
FIG. 4 is a partial perspective view of a piston such as that used in the apparatus of FIG. 1A.

FIG. 3D shows the apparatus 10 as the piston 32 and battering element 14 begin to move towards their retracted position. The normally extended spring 38 pushes the piston 32 towards the rear of the air chamber 66. Air in the chamber 66 may travel through the valves 42 in the piston 32 on out the holes in the body 12 of the air chamber 66.

Figure 3E:
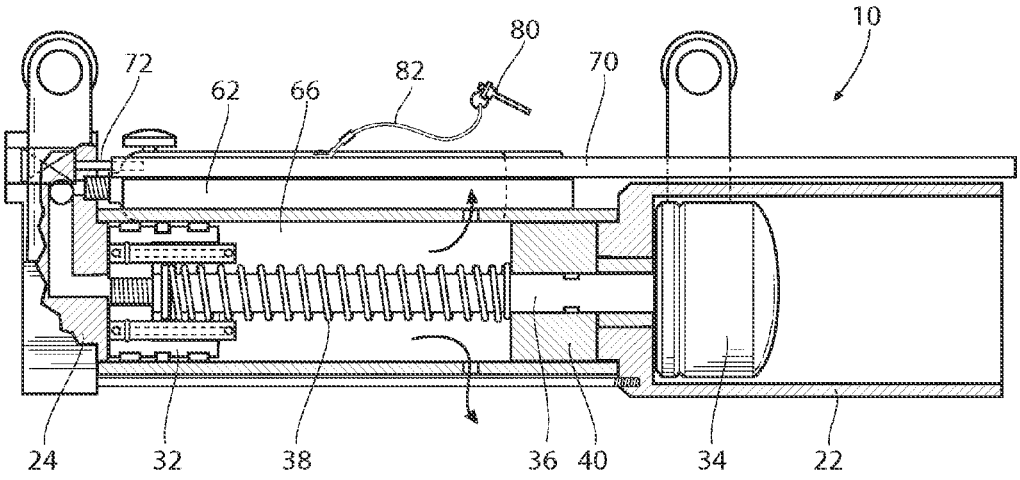

FIG. 3E shows the apparatus 10 in its retracted position. Engagement of the rear surface 54 of the piston 32 with the rear wall 30 of the chamber 66 moves the valves 42 within the piston 32 such that the rear surfaces 52 of the valves 42 are flush with the rear surface 54 of the piston 32, this moving the valves 42 to the closed position. The apparatus 10 is now ready to be used again.

Figure 6:
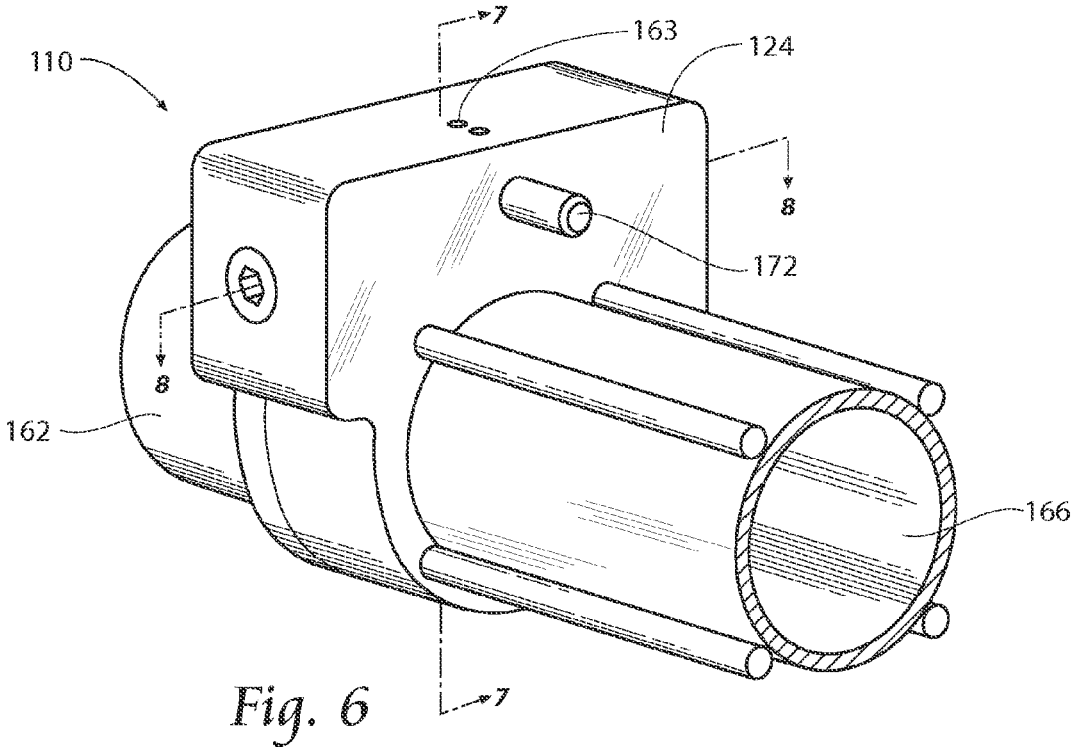
FIG. 6 is a partial perspective view of an alternative embodiment of an apparatus according to the present invention.
Figure 7:
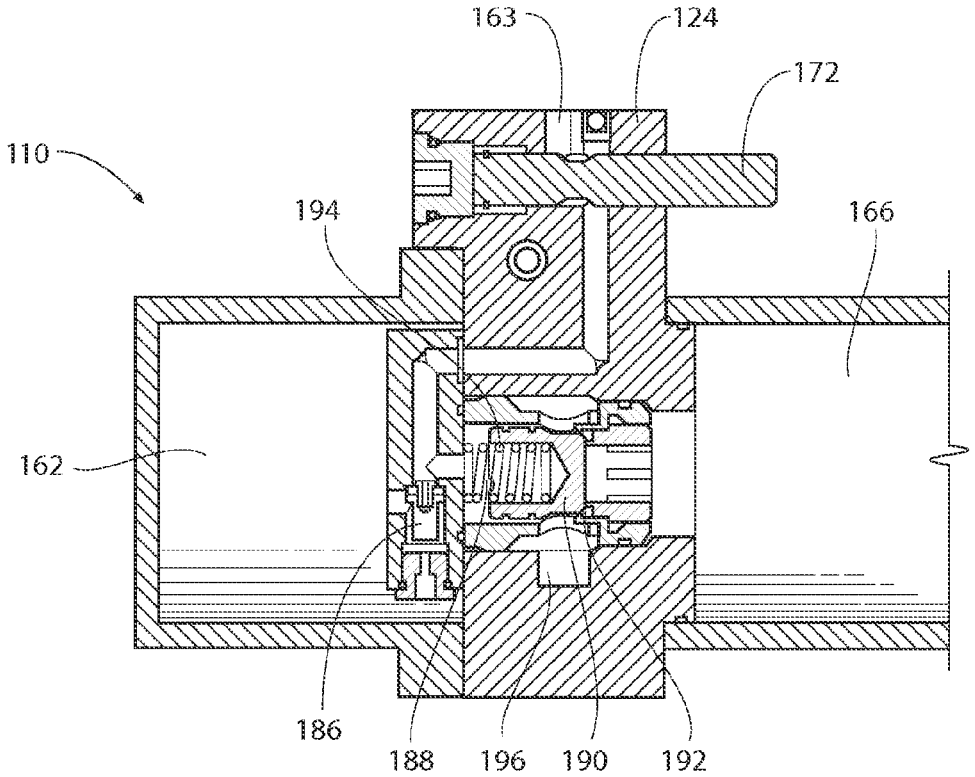
FIG. 7 is a partial sectional view taken along line 7-7 of FIG. 6.
Figure 8:
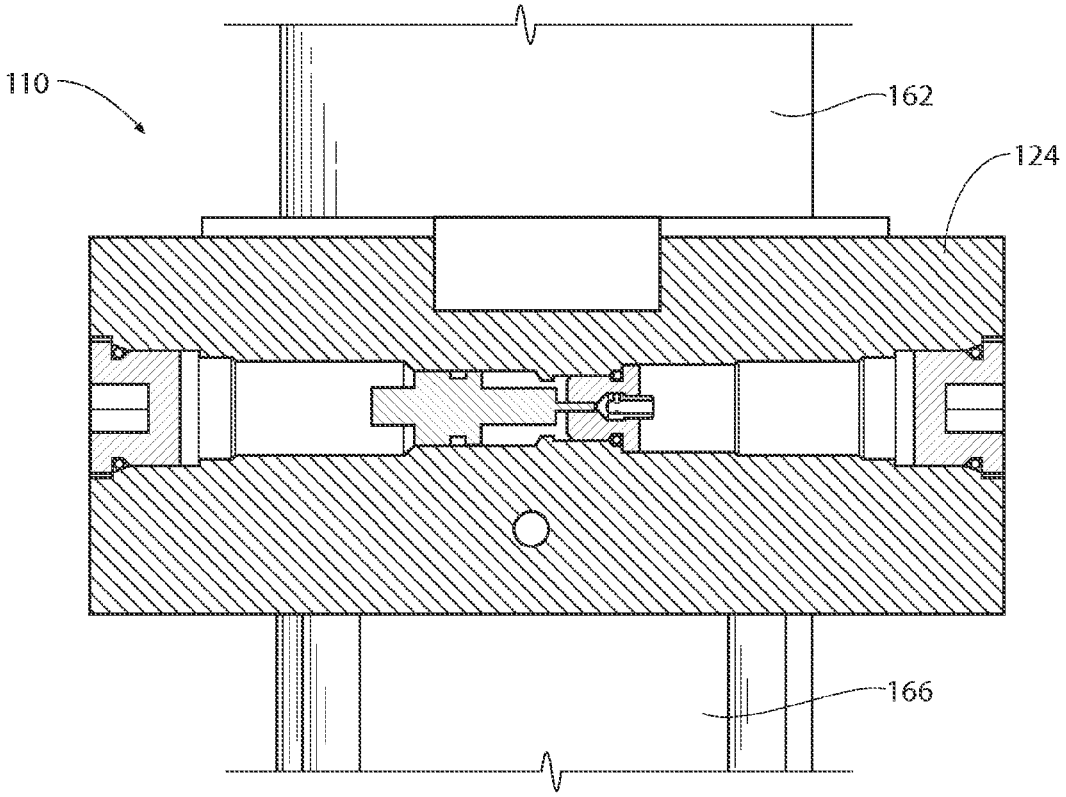
FIG. 8 is a partial sectional view taken along line 8-8 of FIG. 6.

FIGS. 6 through 8 show an alternative embodiment of an apparatus 110 including an integrated reservoir 162. The embodiment of FIGS. 6 through 8 is similar to that described above, however, rather than utilizing an external reservoir tank or bottle 62, the apparatus 110 utilizes an integrated reservoir 162 and has a manifold 124 with a different configuration. In use, the air travels from an external air supply tank (not shown) such as a SCBA bottle, through an air inlet 163 in the manifold 124 to the integrated reservoir 162. Referring to FIG. 7, in the illustrated embodiment air passes through the check valve 186 and into the reservoir. In the illustrated embodiment, air also fills the spring cavity 188 of the valve popper 190, seating the valve poppet 190 against the valve seat 192. The valve seat 192 may include a sealing means such as an o-ring.

The operation of the apparatus 110 illustrated in FIGS. 6 through 8 is generally the same as the embodiment described above and shown in FIGS. 3A through 3E. Upon activation of the triggering mechanism 172, the air travels from the reservoir through the manifold and into the air chamber 166. In the illustrated embodiment, activation of the plunger vents the spring cavity 188 to atmosphere. The air in the reservoir 162 overcomes the force of the main spring 194 and lifts the main valve poppet 190 off the seat allowing the air chamber 166 to be filled. Air enters the chamber 166 through an air inlet 196 which is in fluid communication with the reservoir 162. The air entering the air chamber 166 will push the piston (not shown) into its extended position as described above with respect to the embodiment of FIGS. 3A through 3E.

Figure 9:
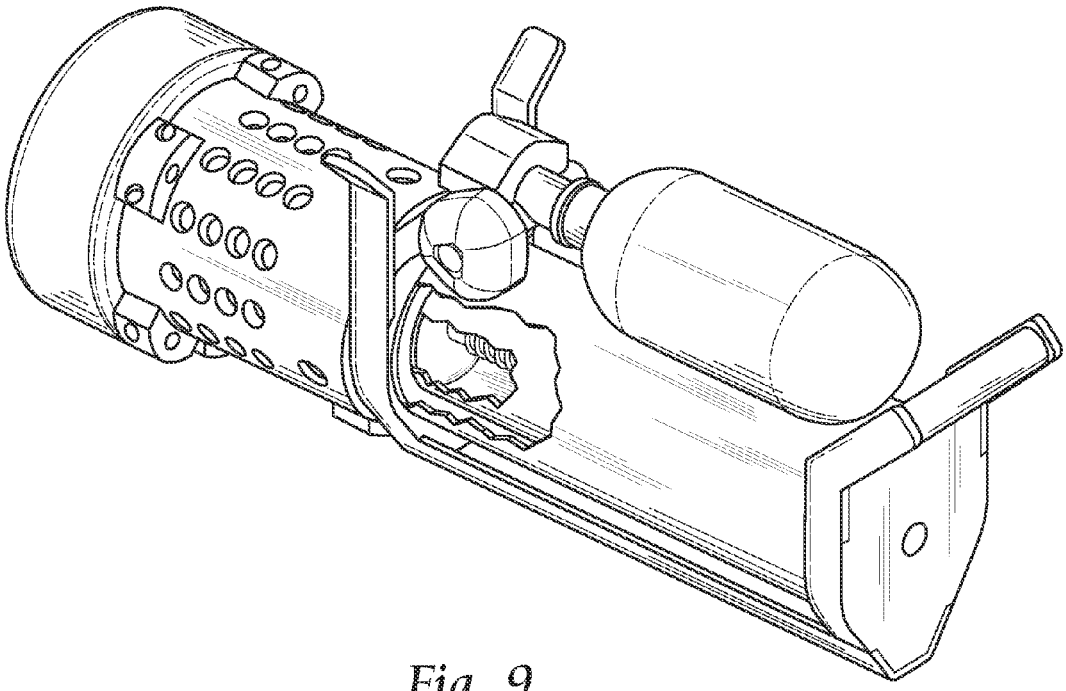
FIG. 9 is a perspective view of an additional alternative embodiment of an apparatus according to the present invention.

FIG. 9 shows an alternative embodiment of an apparatus according to the present invention. The apparatus preferably includes a generally cylindrical body. Preferably, the cylindrical body comprises a dual wall cylinder. The apparatus preferably includes a battering element comprising a battering head attached to a shaft. The inner cylinder acts as an air chamber and houses the piston and the rod portion of the battering element. The outer cylinder acts as a storage reservoir. In this manner, the embodiment of FIG. 9 does not require a reservoir at the rear of the apparatus, for example as shown in the apparatus 110 embodied in FIGS. 7 and 8. The apparatus preferable includes a new bypass valve system which may, if desired, be built into the main circuit. In this manner, the valves built into the piston may be eliminated, reducing cost and complexity to the system. It is further contemplated that the handles may be ergonomically designed to make the apparatus easier to handle.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

I claim:

1. A battering apparatus comprising:

a body, the body having a manifold, a chamber, a cavity, and a bumper between the chamber and the cavity;

the manifold in fluid communication with the chamber;

a piston, the piston movable within the chamber between the manifold and the bumper and having a plurality of movable valves, the valves movable from a closed position to an open position;

a battering element, the battering element disposed at least partially within the cavity, the battering element movable between a first retracted position and a second extended position;

a return mechanism disposed between the bumper and the piston;

a triggering element, the triggering element coupled to the body.

2. The battering apparatus according to claim 1, wherein the return mechanism comprises a spring.

3. A method comprising:

providing a battering apparatus, the battering apparatus comprising a body, the body having a manifold, a chamber, a cavity, and a bumper between the chamber and the cavity, the manifold in fluid communication with the chamber, the manifold having at least one normally closed valve, a piston, the piston movable within the chamber between the manifold and the bumper and having a plurality of movable valves, the valves movable from a closed position to an open position, a battering element, the battering element disposed at least partially within the cavity, the battering element movable between a first retracted position and a second extended position, a return mechanism disposed between the bumper and the piston, and a triggering element, the triggering element coupled to the body;

providing an air source, the air source being in fluid communication with the manifold;

activating the triggering element, the valves of the piston are in the closed position;

extending the battering element;

retracting the battering element, the valves of the piston are in the open position.

4. The method according to claim 2, wherein the return mechanism comprises a spring.

* * * * *